US011180955B1

(12) United States Patent
Zvak

(10) Patent No.: US 11,180,955 B1
(45) Date of Patent: Nov. 23, 2021

(54) CAN HOLDER

(71) Applicant: Radim Zvak, Addison, IL (US)

(72) Inventor: Radim Zvak, Addison, IL (US)

( * ) Notice: Subject to any disclaimer, the term of this patent is extended or adjusted under 35 U.S.C. 154(b) by 0 days.

(21) Appl. No.: 16/871,598

(22) Filed: May 11, 2020

(51) Int. Cl.
*E06C 7/14* (2006.01)
*B44D 3/14* (2006.01)

(52) U.S. Cl.
CPC . *E06C 7/14* (2013.01); *B44D 3/14* (2013.01)

(58) Field of Classification Search
CPC ..... A47B 73/00; A47B 73/008; A47B 73/002; A47B 7/283; A47B 7/285; A47F 7/28; E06C 7/14; B44D 3/14
USPC ..... 182/129; 248/210, 211, 236, 311.2, 310, 248/315; 211/75
See application file for complete search history.

(56) References Cited

U.S. PATENT DOCUMENTS 1,225,229 A * 5/1917 Ellis ..... A47B 73/00 211/74
1,285,817 A * 11/1918 Sklar ..... E06C 7/165 182/120
1,329,593 A * 2/1920 Geiger ..... B43L 25/00 248/205.1
1,394,301 A * 10/1921 Hayes ..... E06C 7/14 248/211
1,581,250 A * 4/1926 Treubig ..... A47K 1/09 248/311.2
D71,202 S * 10/1926 Nitsche ..... D6/531
1,760,803 A * 5/1930 Wirth ..... E06C 7/16 182/122
1,915,958 A * 6/1933 Skirrow ..... B60N 3/007 248/300
1,967,898 A * 7/1934 Nilson ..... A47G 23/0225 248/231.31
2,074,248 A * 3/1937 Barbour ..... A47K 1/08 248/108
2,471,030 A * 5/1949 Foulke ..... A47G 23/0225 211/75
2,598,479 A * 5/1952 Wraith ..... E06C 7/14 248/211
2,628,054 A * 2/1953 Fazakerley ..... B60N 3/103 248/311.2
D171,567 S * 2/1954 Zarzana ..... D6/569
2,674,427 A * 4/1954 Woodward ..... E06C 7/14 248/211

(Continued)

FOREIGN PATENT DOCUMENTS

CH 339353 A * 6/1959 ..... E06C 7/14

*Primary Examiner* — Kimberly T Wood
(74) *Attorney, Agent, or Firm* — Applied Patent Services, PC; James D Palmatier

(57) ABSTRACT

The can holder comprises a can support for attaching to a vertical or horizontal support without tools. The can support comprises a top plate having a can surrounding hole, a can floor portion spaced from the top plate by a vertical spacer, a vertical attach portion and a horizontal attach portion. The horizontal attach portion may comprise a back leg forming a U-shaped channel generally parallel to a top plate back edge and between the back leg and the vertical spacer for attachment to a horizontal structure such as a joist or ladder rung. The vertical attach portion may comprise a U-shaped channel cut out of the top plate and a projecting tab on the can floor portion for attachment to a vertical structure such as a building stud or ladder rung. Slots and holes in top plate are adapted to hold tools.

15 Claims, 5 Drawing Sheets

(56) References Cited

U.S. PATENT DOCUMENTS 2,686,032 A * 8/1954 Thorson ..... E06C 7/14 248/211
2,837,306 A * 6/1958 Elm ..... E06C 7/14 248/210
2,883,134 A * 4/1959 O'Halloran ..... E06C 7/14 248/210
2,934,162 A * 4/1960 Williams ..... E06C 7/165 182/120
3,052,442 A * 9/1962 Rankin, Jr. ..... E06C 7/14 248/210
3,239,181 A * 3/1966 Ellerbrock ..... B44D 3/14 248/210
3,638,894 A * 2/1972 Leutenegger ..... F16B 2/246 248/230.1
3,642,240 A * 2/1972 Hershey ..... E06C 7/14 248/210
3,698,675 A * 10/1972 Lerew ..... A47K 1/09 248/311.2
D228,304 S * 9/1973 Lerew et al. ..... D7/620
3,945,596 A * 3/1976 Marraccini ..... A47C 7/62 248/311.2
3,998,416 A * 12/1976 Benolkin ..... E06C 7/14 248/210
4,433,822 A * 2/1984 Caggiano ..... E06C 7/14 248/210
4,480,810 A * 11/1984 Hall ..... E06C 7/14 182/129
4,613,042 A * 9/1986 Aeschliman ..... E06C 7/14 206/372
4,706,918 A * 11/1987 Wilson ..... E06C 7/14 15/257.06
4,727,890 A * 3/1988 Vincent ..... B60N 3/12 131/329
4,730,802 A * 3/1988 Chatham ..... B25H 3/06 182/129
4,979,710 A * 12/1990 Baldwin ..... E06C 7/14 248/210
5,079,795 A * 1/1992 Schmid ..... B44D 3/126 15/257.06
5,257,765 A * 11/1993 Halle ..... A47C 7/624 248/222.13
D356,232 S * 3/1995 Armstrong ..... D24/226
5,395,081 A * 3/1995 Vollink ..... A47G 7/044 248/217.1
5,429,205 A * 7/1995 Collins ..... E06C 7/14 182/122
5,673,885 A * 10/1997 Pham ..... E06C 7/14 182/129
5,806,709 A * 9/1998 Marshall, II ..... B44D 3/14 220/755
6,513,626 B2 * 2/2003 MacSweeney ..... E06C 7/14 182/129
D484,251 S * 12/2003 Pruett ..... D25/68
6,688,570 B1 * 2/2004 Mundt ..... E06C 7/14 182/121
8,201,661 B1 * 6/2012 O'Connell, Sr. ..... E06C 7/16 182/122
8,272,478 B2 * 9/2012 Astor ..... E06C 7/14 182/129
8,469,148 B2 * 6/2013 Perry ..... E06C 7/14 182/129
8,672,279 B2 * 3/2014 Schirmacher ..... E06C 7/14 248/210
10,718,120 B1 * 7/2020 Haney ..... E04G 5/003
2009/0026155 A1 * 1/2009 Bernard ..... B25H 3/006 211/70.6
2009/0250294 A1 * 10/2009 Byers ..... E06C 7/14 182/129

* cited by examiner

CAN HOLDER

FIELD OF THE INVENTION

The Can Holder is a device for holding a can of work material by removable attachment to a support such as a joist or ladder.

BACKGROUND OF THE INVENTION

A can holder is needed to hold a can of material at a convenient height while working with the material. In a field such as plumbing, PVC glue may be needed for joining pipes. The task takes two hands and the glue should be nearby. Other materials such as paint, grease, etc. are provided in cans having removable lids. The cans require a stable support to keep from spilling. Often, the workspace is on a ladder or in a construction area. The can of material must be accessible and safe from falling or spilling. The prior art includes hooks, wire hangers, or fastened to fixtures by clamps.

Of special concern is on a ladder where user safety on a ladder is dependent on use of hands. The prior art does not disclose a can holder that supports one or more cans by a shelf and surround that is adapted to attach to a vertical or horizontal support without tools.

Accordingly, there is a need for a device such as the Can Holder that has a means to attach to a vertical support such as a ladder or a wall stud and has a means to attach to a horizontal fixture such as a joist or ladder rung. The Can Holder may also be adapted to support tools such as screwdriver, wrench or hammer.

BRIEF DESCRIPTION OF THE PRESENT INVENTION

The Can Holder may comprise a top plate, a vertical attach portion, a horizontal attach portion and a can support. The top plate oriented in a generally horizontal position. The top plate may have material removed to form vertical attach portion opening in a front edge. The vertical attach portion comprising a three sided opening having a generally rectangular shape. A plurality of notches formed in the three sided opening may be adapted to engage edges of a U-shaped or I-beam shaped vertical fixture.

The can support may comprise a can opening in the top plate, a vertical spacer on the top plate and a can bottom portion on the vertical spacer. The can bottom portion spaced from the top plate and disposed vertically below the can opening. The can bottom support may be disposed generally parallel to the top plate. The vertical spacer extending generally perpendicular to the support angle. The horizontal attach portion may be on a back edge of the top plate atop plate disposed adjacent to the can opening. The horizontal attach portion may comprise a leg spaced from the top plate by a flange. The flange may sit atop a horizontal structure such as a joist or ladder leg with the horizontal structure sandwiched between the leg and the vertical spacer.

The above description sets forth, rather broadly, the more important features of the present invention so that the detailed description of the preferred embodiment that follows may be better understood and contributions of the present invention to the art may be better appreciated. There are, of course, additional features of the invention that will be described below and will form the subject matter of claims. In this respect, before explaining at least one preferred embodiment of the invention in detail, it is to be understood that the invention is not limited in its application to the details of the construction and to the arrangement of the components set forth in the following description or as illustrated in the drawings. The invention is capable of other embodiments and of being practiced and carried out in various ways. Also, it is to be understood that the phraseology and terminology employed herein are for the purpose of description and should not be regarded as limiting.

DETAILED DESCRIPTION OF THE INVENTION

In the following detailed description of the preferred embodiments, reference is made to the accompanying drawings, which form a part of this application. The drawings show, by way of illustration, specific embodiments in which the invention may be practiced. It is to be understood that other embodiments may be utilized and structural changes may be made without departing from the scope of the present invention. It is to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting. It should be appreciated that the invention can be used for any suitable.

Figure 1:
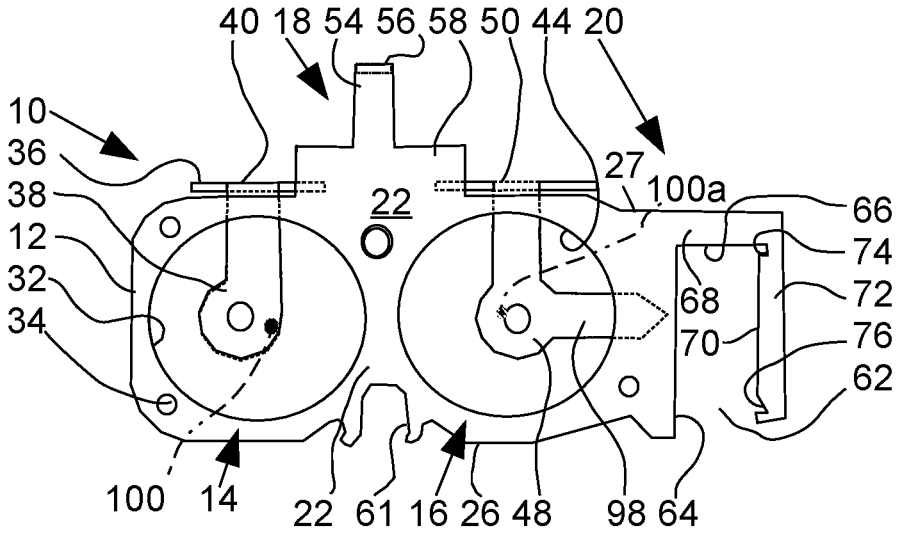
FIG. 1 is a top plan view of the Can Holder.
Figure 2:
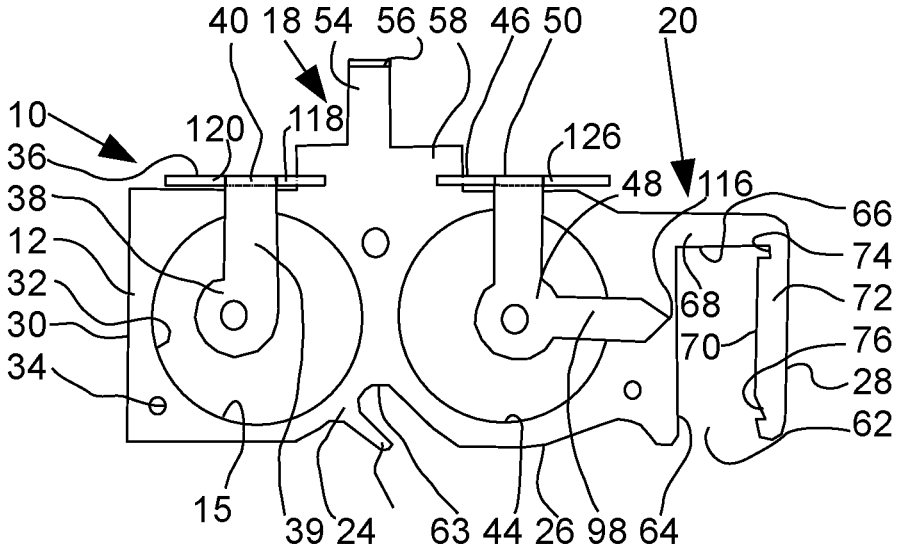
FIG. 2 is a bottom plan view thereof.

Referring to FIGS. 1 and 2, the can holder indicated generally by the element number 10 may comprise a generally flat top plate 12 having a first can support 14, second can support 16, horizontal attach portion 18 and vertical attach portion 20. Top plate 12 may comprise a top side 22, a bottom side 24, a front edge 26, a back edge 27, a first side edge 28 and a second side edge 30. Top plate 12 may further comprise a first can hole 32, a plurality of tool holes 34, and a first can support 36. First can hole 32 may comprise perimeter 15 and axis 100 approximately at a centerpoint. First can hole 32 may extend from top side 22 to bottom side 24. First can hole 32 may be disposed in spaced relation to tool holes 34, and adjacent to first can support 36. First can support 36 may comprise a first can floor portion 38 and a first vertical spacer 40. First vertical spacer 40 may be on top plate 12. First can floor portion 38 may comprise first floor arm 39 and first can bottom portion 41. First floor arm 39 may be on first vertical spacer 40 and first can bottom portion 41. First can bottom portion 41 spaced from top plate 12 and on axis 100. First vertical spacer 40 may be disposed in a generally perpendicular orientation to top plate 12. First can floor portion 38 may be disposed in a position generally concentric with and vertically spaced from first can hole 32. First can floor portion 38 spaced from top plate 12 in a generally parallel orientation to top plate 12.

Continuing to refer to FIGS. 1 and 2, top plate 12 may further comprise second can hole 44 extending through top plate 12 from top 22 to bottom 24. Second can hole 44 is spaced from first can hole 32. Second can hole 44 comprising a perimeter 33 and an axis 100*a*. Second can support 46 may comprise a second can floor portion 48 and a second vertical spacer 50. Second vertical spacer 50 may be on top plate 12 in spaced relation to first can support 36. Second can floor portion 48 may be on second vertical spacer 50 and may be disposed in a generally perpendicular orientation to top plate 12. Second can floor portion 48 may be disposed in a position generally concentric with and vertically spaced from second can hole 44. The first can hole 32 is generally spaced from the back leg 56 a distance roughly equal to the distance from the leg back 56 to the second can hole. That is, the first can hole 32 and second can hole 44 are generally equidistant to the leg.

Continuing to refer to FIGS. 1 and 2, horizontal attach portion 18 may be on top plate 12 disposed on second side 28 adjacent to second can hole 44. Horizontal attach portion 18 may comprise horizontal support flange 54 and back leg 56. Horizontal support flange 54 may be on top plate. Horizontal support flange 54 may comprise off set 58 extending therefrom. Back leg 56 may be on off set 58 and spaced from top plate 12. Back leg 56 may be generally perpendicular to top plate 12. Tool notch 61 may feature a slide in opening adapted to engage a tool such as a brush, hammer or drill (not shown). Alternative tool slot 63 may be formed in front edge adapted to engage a tool by a neck portion (not shown).

Continuing to refer to FIGS. 1 and 2, vertical attach portion 20 may comprise a three sided opening 62 in front edge 26 having a generally rectangular shape. Three sided opening 62 may comprise a first vertical attach side 64 on the top plate 12 adjacent to second can hole 44, a second vertical attach side 66 on top plate adjacent to back side 27 and a third vertical attach side 70 on top plate 12 adjacent to second side edge 28. Third vertical attach side 70 may further comprise first notch 74 and second notch 76. It should be understood, the vertical attach portion 20 may be disposed on top plate 12 adjacent the front edge 26 or the second side edge 30. The pawl 98 may be disposed on either first can support 36 or second can support 46.

Figure 3:
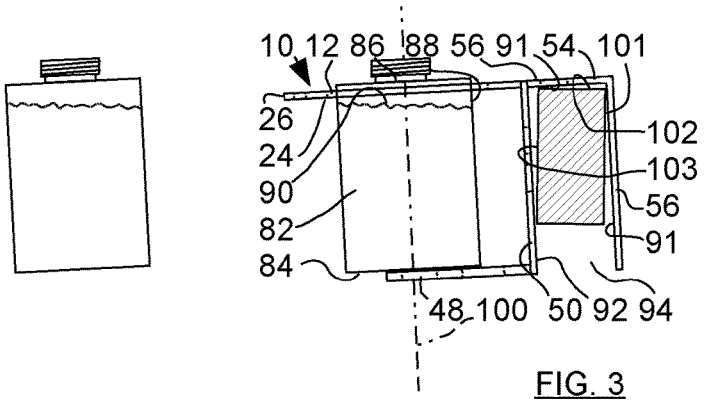
FIG. 3 is a side elevation thereof, the Can Holder engaged to a horizontal joist.
Figure 7:
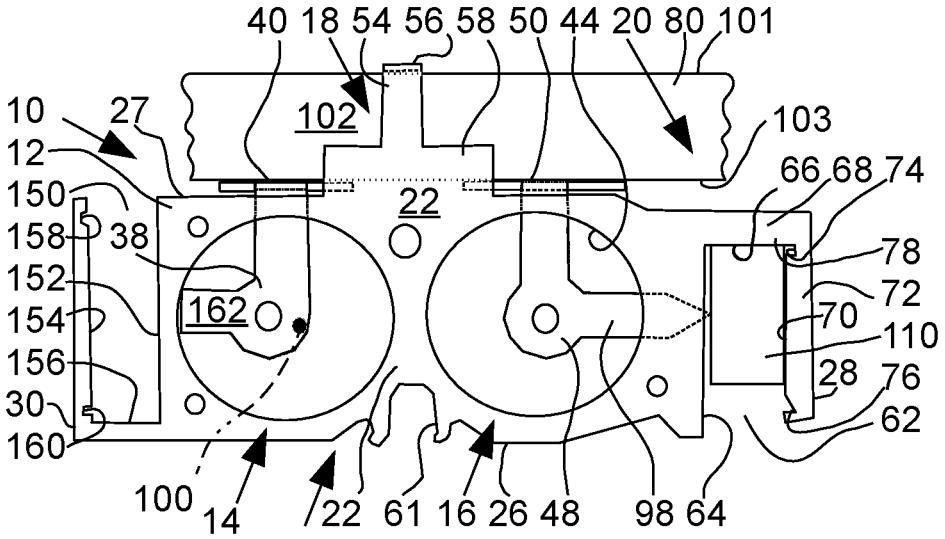
FIG. 7 is a top plan view of the can holder of FIG. 1 attached to a vertical structure and horizontal structure.

Referring to FIGS. 3 and 7, can holder 10 may be removably attached to horizontal support 80 such as a joist. Horizontal attach portion 20 may comprise three sided surround 94 disposed between second vertical spacer 50 and back leg 56. Back leg 56 may comprise inside surface 91 adapted to bear against distal side 101 of horizontal support 80. Second vertical spacer 50 may comprise support side 92 adapted to bear against proximal side 102 of horizontal support 80. Horizontal support flange 54 may comprise bottom side 93 adapted to bear against top side 103 of horizontal support 80 whereby top plate 12 may be supported in a generally horizontal orientation by can holder 10 cantilevered on to horizontal support 80. Second can hole 44 may comprise an axis 100. Glue can 82 may be in second can hole 44. Can 82 may comprise closed can bottom 84, open can top 86, and can side 88. Can side 88 is on can top 86 and can bottom 84. Glue 90 is disposed in glue can 82. Second can floor portion 48 is disposed a predetermined spacing from top plate 12 whereby second can floor portion 48 bears on can bottom 84 to dispose can 82 on axis 100 and having top plate 12 between can top 86 and can bottom 84. In the preferred embodiment, the second vertical support 56 may be adjusted to retain the glue 90 adjacent the top plate 12.

Figure 4:
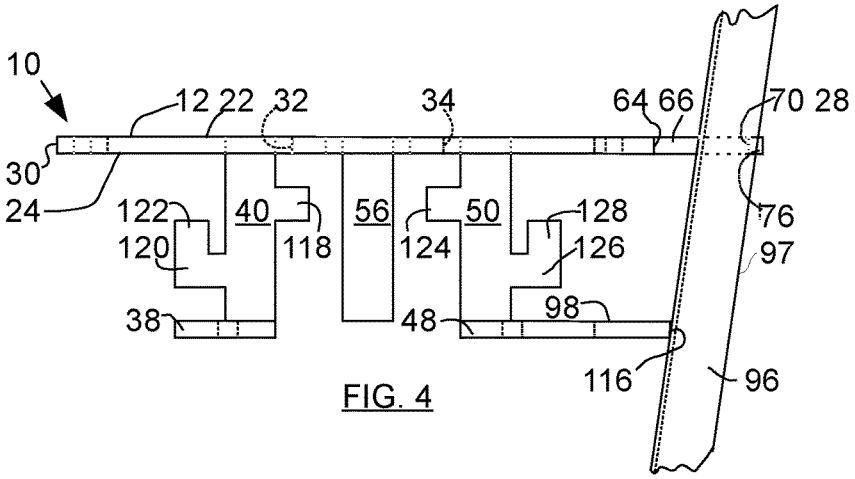
FIG. 4 is a front elevation view thereof, the Can Holder engaged to a ladder leg.
Figure 6:
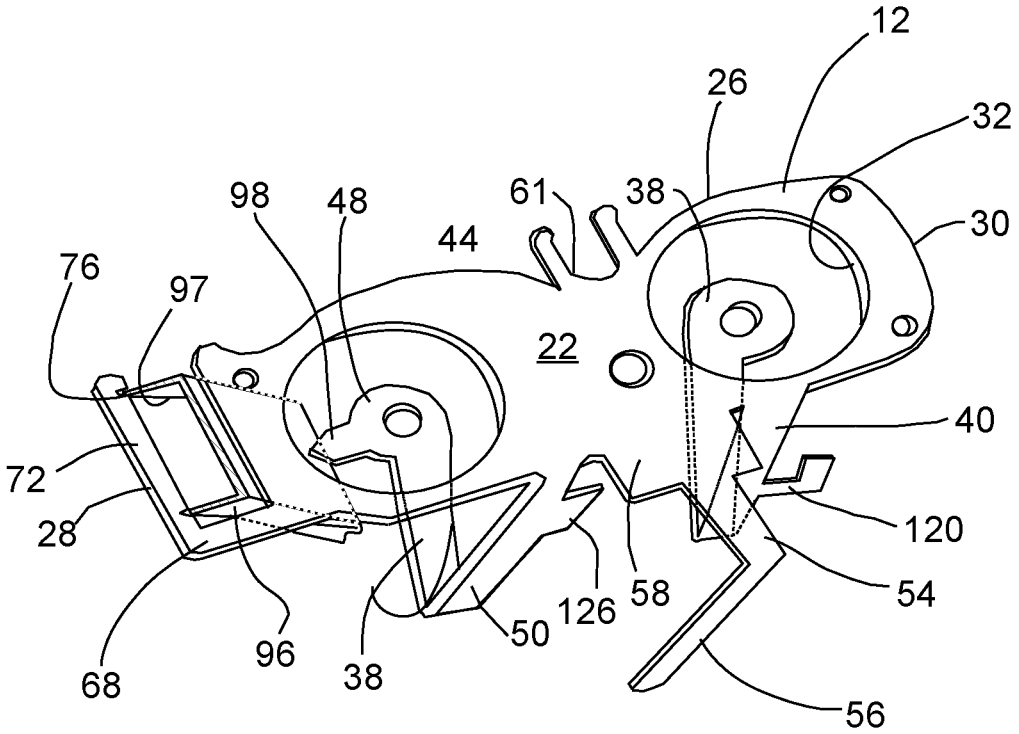
FIG. 6 is a back elevation view of a first alternative embodiment of the Can Holder of FIG. 1.

Referring to FIGS. 4 and 6, can holder 10 may be disposed on a ladder leg 96. Ladder leg 96 may have an I-beam or U-channel construction edge 97 in notch 76. Second can bottom support 48 may further comprise support pawl 98 extending horizontally in a direction away from first can hole 32. Support pawl 98 is disposed to engage ladder leg 96 whereby top plate 12 is disposed in a generally horizontal orientation. A first stability wing 118 and first hook wing 120 on first vertical spacer 40. First stability wing 118 and first hook wing 120 are disposed on opposing sides of first vertical spacer 40 to stabilize first can floor portion 38. First stability wing 118 and first hook wing 120 are adapted to bear against proximal side 102 (FIG. 3). First hook wing 120 may further comprise first hook projection 122. First hook projection 122 may be on first hook wing 120 and spaced from first vertical spacer 40. Second vertical spacer 50 may further comprise a second stability wing 124 and second hook wing 126. Second stability wing 124 and second hook wing 126 are adapted to stabilize second can floor portion 48. Second stability wing 124 and second hook wing 126 are adapted to bear against proximal side 102 (FIG. 3). Second hook wing 126 may likewise comprise second hook projection spaced from first vertical spacer 40.

Figure 5:
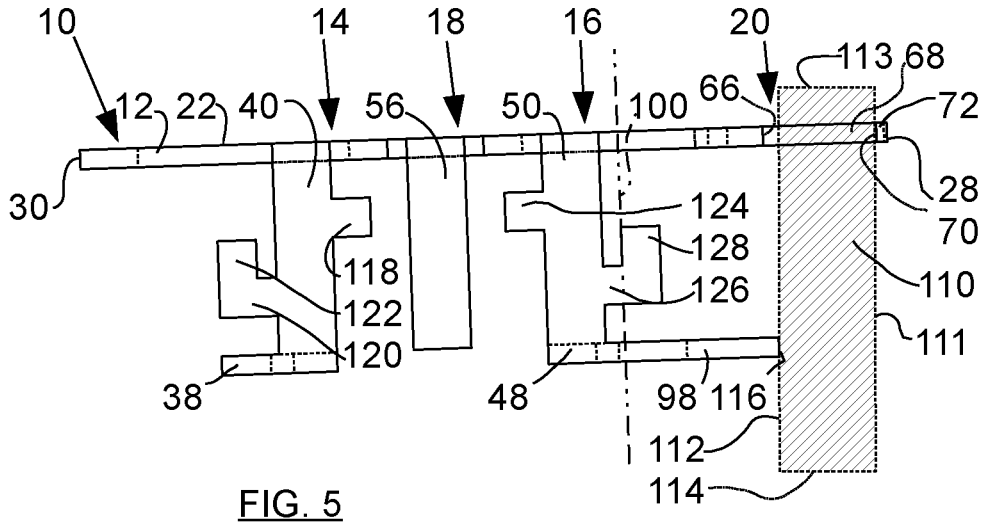
FIG. 5 is a top back perspective view thereof.

Referring to FIGS. 5 and 7, can holder 10 may be disposed on a vertical support 110 such as building stud. Second can bottom support 48 may further comprise support pawl 98 disposed to a predetermined position below second side 28. Support pawl 98 may be adapted to engage vertical support 110 whereby top plate 12 is disposed in a generally horizontal orientation. Vertical support 110 may have outside 111, inside 112, top side 113 and bottom 114. Vertical support outside 111 may bear against third side 70. Support pawl 98 may bear against inside 112, whereby axis 100 is disposed in a generally vertical orientation. Support pawl 98 may further comprise engagement point 116 for piercingly engaging vertical support inside 112.

Continuing to refer to FIG. 7, can holder 10 may comprise second vertical attach portion 150 opening on back edge 27. Second vertical attach portion 150 may comprise first side edge 152 on top plate 12, a back side edge 154 adjacent front top plate edge 26, third side edge 154 adjacent second top plate side edge 30 and second support pawl 162 extending from first can bottom support 38. As described with respect to first vertical attach portion 62 a plurality of notches 158, 160 may be formed in second vertical attach portion. Second vertical attach portion 150 is adapted to engage a vertical structure on three sides without the use of tools in a cantilever fashion to thereby hold the top plate 12 in a generally horizontal orientation.

Figure 8:
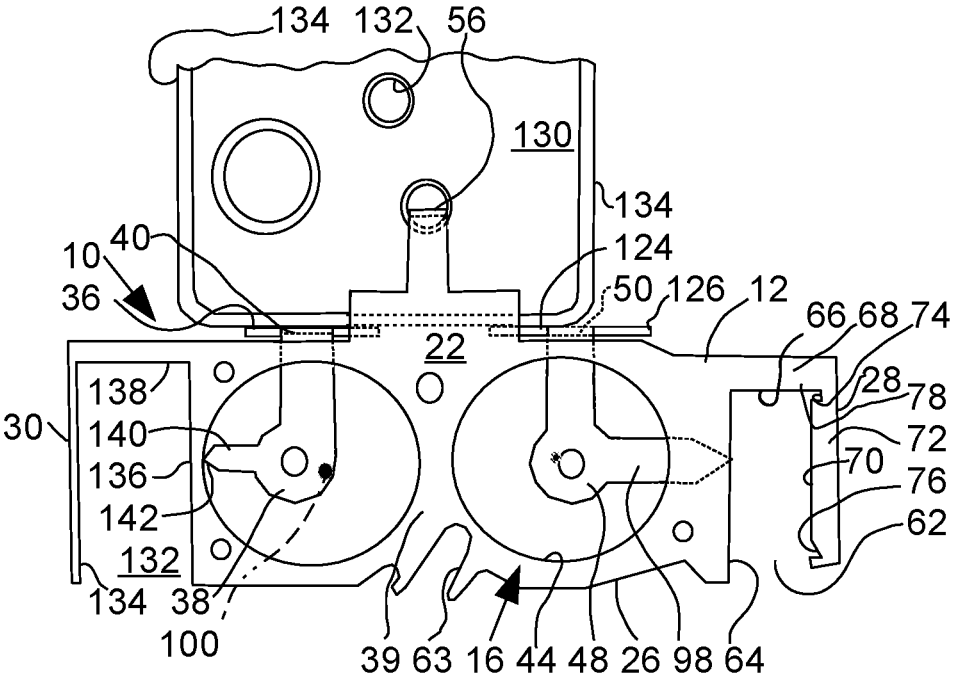
FIG. 8 is a top plan view of the first alternative embodiment of the can holder of FIG. 2 attached to a ladder top.

Referring to FIG. 8, can holder 10 may be disposed on ladder head 130. Ladder head 130 may comprise a perimeter 132 and a plurality of tool holes 134. Leg 56 may be disposed in one of the plurality of tool holes 134. Perimeter 132 may bear against first and second vertical spacers, 40, 50. In addition, stability wings 124, 126 may be adapted to bear against perimeter 132 to prevent can holder 10 from pivoting about leg 56.

Continuing to refer to FIG. 8, can holder 10 may further comprise second vertical attach portion 129 on second side 30. Second vertical attach portion 129 may comprise a rectangular opening 132 in front edge 26. Rectangular opening 132 comprising an outer edge 134, an inner edge 136 and an end edge 138. Second support pawl 140 may be on first can support 36. Second support pawl 140 may extend to a point 142 disposed below inner edge 136.

Figure 9:
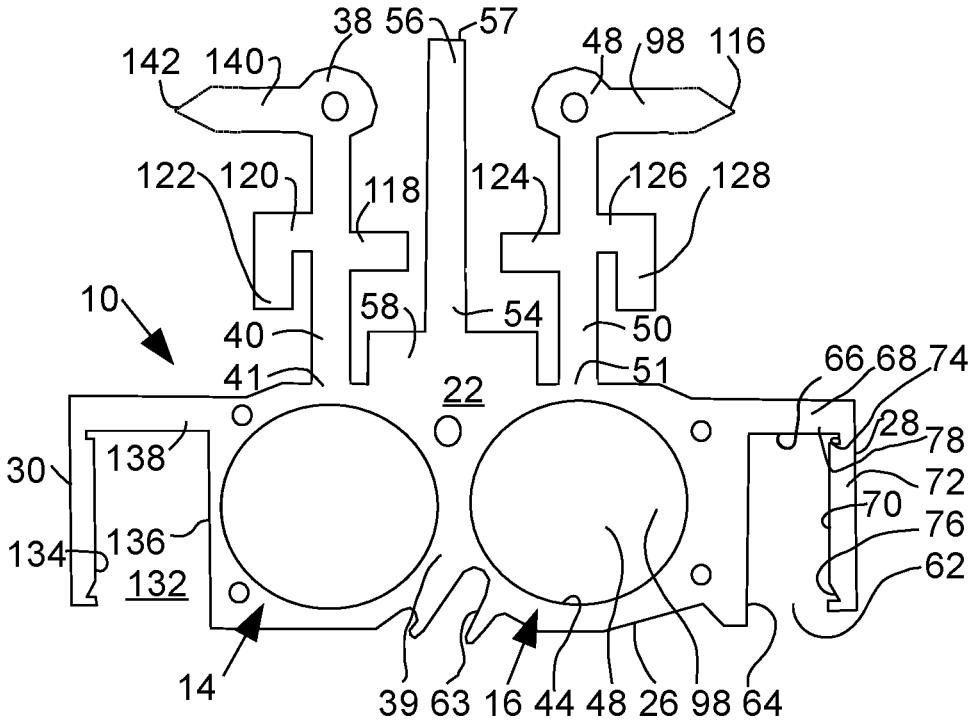
FIG. 9 is a top plan view of the cutout of the can holder of FIG. 8.

Referring to FIG. 9, the can holder 10 may be formed of a bendable material such as metal having a cutout shape. The first vertical spacer 40 having a first end 41 attached adjacent to the back edge 27. The back leg 56 having a leg end 57 spaced from the flange 58. The method of manufacturing the can holder 10 may comprise:

1. Provide a plate of metal;
2. Cut the first can hole 32;
3. Cut the second can hole 44;
4. Cut along the front edge 26 including the tool slot 63;
5. Cut along the first side edge 28;
6. Cut along the second side edge 30;
7. Cut out the support leg 56 and flange 58;
8. Cut out the first can support 36;
9. Cut out the second can support 46;
10. Cut out the back edge 27;
11. Cut out the first three sided opening 64;
12. Cut out the second three sided opening 132;
13. Bend the first can support 36 at the intersection with the back edge 27 to an orientation generally perpendicular to the top plate bottom 24;
14. Bend the first can bottom support portion 38 to an orientation generally perpendicular to the first can support 36;
15. Bend the second can support 46 at the intersection with the back edge 27 to a generally perpendicular orientation to the top plate bottom 24;
16. Bend the second can bottom support portion 48 to an orientation generally perpendicular to the second can support 46; and
17. Bend the support leg 56 at the intersection with the flange 58 to a generally perpendicular orientation to the top plate bottom 24.

Although the description above contains many specifications, these should not be construed as limiting the scope of the invention but as merely providing illustrations of some of the embodiments of this invention. Thus, the scope of the invention should be determined by the appended claims and their legal equivalents rather than by the examples given. Further, the present invention has been shown and described with reference to the foregoing exemplary embodiments. It is to be understood, however, that other forms, details, and embodiments may be made without departing from the spirit and scope of the invention which is defined in the following claims.

I claim:

1. A one piece can holder for supporting a can of material to a generally horizontal support or a generally vertical support, the one piece can holder comprising:

a top plate, the top plate comprising a front edge, a first side edge, a second side edge, a back edge, a top side, a bottom side, a first can hole, a second can hole, a first can support and a second can support, the first can hole spaced from the second can hole, each of the first and second can holes extending through the top plate from the top side to the bottom side, the second can hole comprising an axis, the axis oriented generally perpendicular to the top plate, the first can support on the back edge adjacent to the first can hole, the first can support comprising a first can floor portion, the first can floor portion spaced from the bottom side, the second can support on the back edge adjacent to the second can hole, the second can support comprising a second can floor portion, the second can floor portion on the axis;

a vertical attach portion on the top plate, the vertical attach portion comprising a three sided opening and a pawl, the three sided opening in the top plate between the second can hole and the second side edge, the pawl on the second can support, the pawl extending generally parallel to the top plate toward the second side edge, the three sided opening and the pawl disposed to engage the generally vertical support in a cantilever attachment having the generally vertical support in the three sided opening and the pawl bearing against the generally vertical support below the three sided opening; and a horizontal attach portion on the top plate, comprising a three sided surround, whereby the can holder is held in place having the top plate in a generally horizontal orientation with one of the vertical attach portion or the horizontal attach portion.

2. The can holder of claim 1, wherein the three sided opening further comprises a generally rectangular shape, a first vertical attach side, a second vertical attach side and a third vertical attach side, each of the first, second and third vertical attach sides on the top plate, the first vertical attach side adjacent to the second can hole, the second vertical attach side adjacent to the back edge, the third vertical attach side adjacent to the second side edge, the pawl further comprising a point spaced from the second can support, the point disposed below the first vertical attach side, the point adapted to bear against the generally vertical support whereby the can holder is cantilevered on the generally vertical support.

3. The can holder of claim 2, further comprising a first notch and a second notch, the first and second notch formed in one of the first, second or third vertical attach sides, the first and second notch spaced from each other, the first and second notches adapted to engage the generally vertical support along an I-beam type edge surface.

4. The can holder of claim 3, further comprising a first notch and a second notch, the first and second notches in the third vertical attach side.

5. The can holder of claim 2, wherein the horizontal support portion further comprises an offset, a support flange and a back leg, the offset on the top plate, the support flange on the offset, the offset between the top plate and the support flange, the support flange spaced from the top plate, the back leg on the support flange, the back leg spaced from the back edge, the back leg disposed generally perpendicular to the top plate.

6. The can holder of claim 5, further comprising a first vertical spacer on the first can support, the first can floor portion on the first vertical spacer, the first vertical spacer disposed generally parallel to back leg.

7. The can holder of claim 6, further comprising a first stability wing on the first vertical spacer.

8. The can holder of claim 1, further comprising a first hook wing and a first stability wing, the first hook wing and the first stability wing on the first can support.

9. The can holder of claim 6, further comprising a first hook wing on the first vertical spacer.

10. The can holder of claim 1, further comprising a tool slot in the top plate.

11. A one piece can holder for attaching to a generally horizontal support or a generally vertical support, the one piece can holder comprising:

a top plate, the top plate comprising a front edge, a first side edge, a second side edge, a back edge, a top side, a bottom side and a first can hole, the first can hole extending through the top plate from the top side to the bottom side, the first can hole comprising an axis, the axis oriented generally perpendicular to the top plate;

a first can support on the top plate, the first can support comprising a first vertical spacer and a first can floor portion, the first vertical spacer on the back edge, the first can floor portion on the first vertical spacer, the first can floor portion spaced from the bottom side, the first can floor portion on the axis;

a vertical attach portion on the top plate, the vertical attach portion comprising a three sided opening in the front edge and a pawl on the first can floor portion, the three sided opening having a generally rectangular shape comprising a first vertical attach side adjacent to the first can hole, a second vertical attach side adjacent to the back edge and a third vertical attach side adjacent the first side edge, each of the first, second and third vertical attach sides on the top plate, the pawl comprising a point, the point disposed below the first vertical attach side, the point adapted to bear against the generally vertical support when the generally vertical support is disposed in the three sided opening; and a horizontal attach portion on the top plate, the horizontal attach portion comprises a three sided surround adjacent to the back edge, the three sided surround comprising a support flange and a back leg, the support flange generally parallel to the top plate, the back leg spaced from the first vertical spacer forming the three sided surround with the support flange on the top plate, the three sided surround adapted to receive the generally horizontal support, the back leg generally perpendicular to the top plate.

12. The can holder of claim 11 further comprising a tool slot and a first and second notches in the top plate, the tool slot in the top plate, the first and second notches on the three sided opening.

13. The can holder of claim 11, further comprising a second can hole, and a second can support, the second can hole in the top plate, the second can hole comprising a second axis, the second can support on the top plate, the second can support comprising a second vertical spacer and a second can bottom support, the second vertical spacer on the back edge, the second can bottom support on the second vertical spacer, the second can bottom support spaced from the top plate, the second can bottom support on the axis, the horizontal surround further comprising the second vertical spacer.

14. A one piece can holder adapted to attach to a stud or a joist, the one piece can holder comprising:

a top plate, the top plate comprising a front edge, a first side edge, a second side edge, a back edge, a top side, a bottom side, a first can hole and a second can hole, each of the first and second can holes extending through the top plate from the top side to the bottom side, the first can hole spaced from the second can hole, the first can hole comprising an axis, the axis oriented generally perpendicular to the top plate;

a first can support, the first can support comprising a first vertical spacer and a first can floor portion, the first vertical spacer on the back edge adjacent to the first can hole, the first can floor portion on the first vertical spacer, the first can floor portion spaced from the bottom side, the first can floor portion on the axis;

a second can support, the second can support comprising a second vertical spacer and a second can floor portion, the second vertical spacer on the top plate adjacent to the second can hole, the second can floor portion on the second vertical spacer, the second can floor portion spaced from the bottom side a support pawl on one of the first or second can floor portions, the support pawl spaced from the top plate, the support pawl comprising a tip;

the tip spaced from either the first or second can;

a first and second vertical attach portions on the top plate, the first vertical attach portion comprising a first generally rectangular three sided opening in the front edge adjacent to the first side edge, the second vertical attach portion comprising a second three sided opening on the top plate between the second can hole and the second side edge, wherein each of the first or second three sided openings are adapted to receive the stud, the tip adapted to engage the stud; and a horizontal attach portion on the top plate, the horizontal attach portion comprises a three sided surround formed by the first and second vertical spacers, a support flange and a back leg adjacent to the back edge and adapted to receive the joist, the back leg on the support flange, the support flange on the back edge, the back leg spaced from the back edge, the back leg generally perpendicular to the top plate.

15. The can holder of claim 14, wherein the back leg is generally parallel to and spaced from the first vertical spacer, the second vertical spacer generally parallel to and spaced from the back leg.

* * * * *